United States Patent [19]

Hoffman

[11] Patent Number: 4,821,652

[45] Date of Patent: Apr. 18, 1989

[54] WALL SAFE SIMULATING AN AIR VENT

[76] Inventor: Steven H. Hoffman, 26005 Corriente La., Mission Viejo, Calif. 92691

[21] Appl. No.: 98,559

[22] Filed: Sep. 21, 1987

[51] Int. Cl.[4] ..... E05G 3/00

[52] U.S. Cl. ..... 109/23; 109/54; 70/DIG. 81

[58] Field of Search ..... 70/DIG. 81, 452, 456 R; 109/23, 54; 292/DIG. 30

[56] References Cited

U.S. PATENT DOCUMENTS

| | | | |
|---|---|---|---|
| 968,536 | 8/1910 | Brucklacher | 70/DIG. 81 |
| 3,181,905 | 5/1965 | Bisbing | 292/DIG. 30 |
| 3,415,300 | 12/1968 | Worcester | 70/456 R |
| 3,481,288 | 12/1969 | Teleky | 109/58 |
| 3,715,998 | 2/1973 | Teleky | 109/58 |
| 3,717,112 | 2/1973 | Welty | 109/54 |
| 3,999,493 | 12/1976 | Gulya | 109/23 |
| 4,040,365 | 8/1977 | Baxter | 109/50 |
| 4,083,314 | 4/1978 | Garvin | 109/54 |
| 4,123,978 | 11/1978 | Lentini | 109/51 |
| 4,172,424 | 10/1979 | dePalau | 109/50 |
| 4,176,533 | 12/1979 | Nordendale | 70/115 |
| 4,370,935 | 2/1983 | Link | 109/51 |
| 4,398,470 | 8/1983 | Williams et al. | 109/52 |

OTHER PUBLICATIONS

Circular dated 10/4/81 for a wall safe distributed by Carol Products Co., Inc. Irvington, N.J., registered under the trademark "VENT A VAULT".

*Primary Examiner*—Robert L. Wolfe

*Attorney, Agent, or Firm*—Blakely, Sokoloff, Taylor & Zafman

[57] ABSTRACT

An apparatus for storing and hiding valuables within the wall of a building, comprising a removable assembly and adhesive attachment means. The removable assembly includes a unitary receptacle for containing the valuables and a metal front panel. The unitary receptacle fits within a hole formed in the wall. The metal front panel is the type used for a conventional air vent and is securely attached to the unitary receptacle. The adhesive attachment means is adapted to attach the removable assembly to a section of the wall adjacent the assembly, thereby providing the appearance of a conventional air vent. The adhesive attachment means is further adapted to allow manual detachment of the removable assembly from the wall for the removal or addition of valuables.

19 Claims, 2 Drawing Sheets

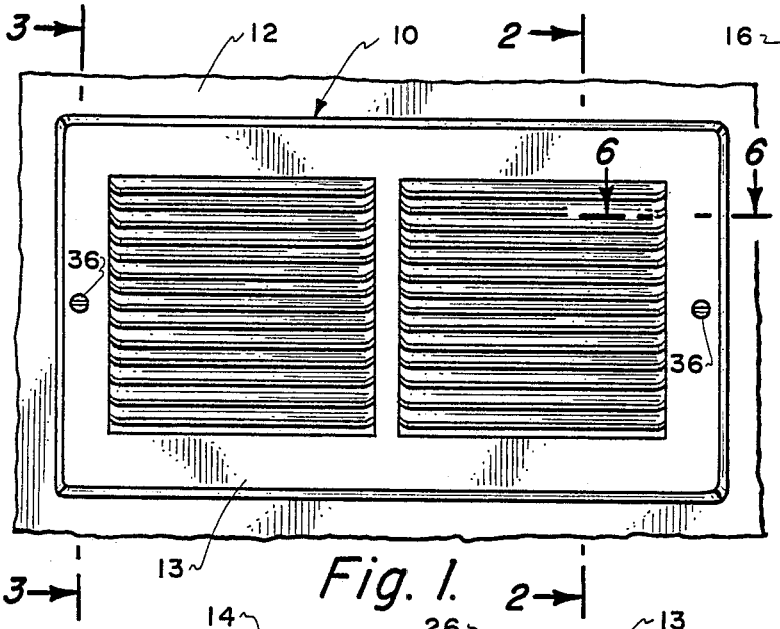
Fig. 1.
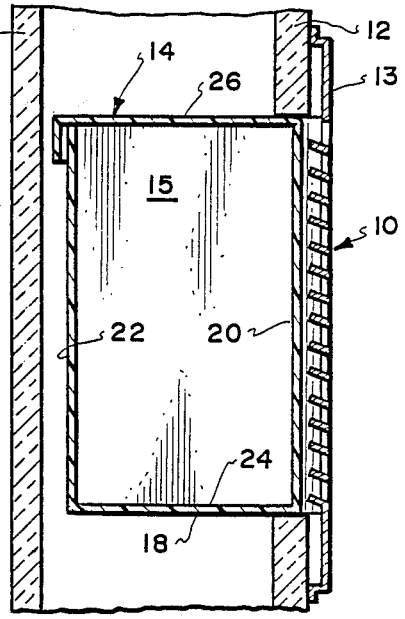
Fig. 2.
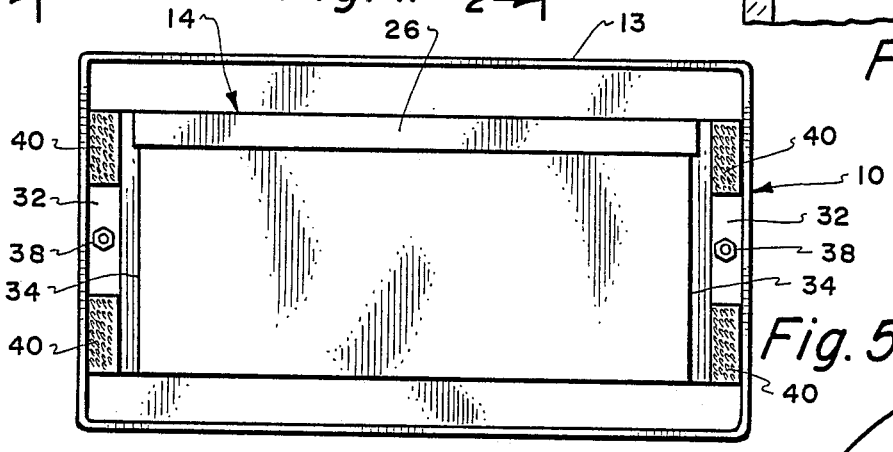
Fig. 5.
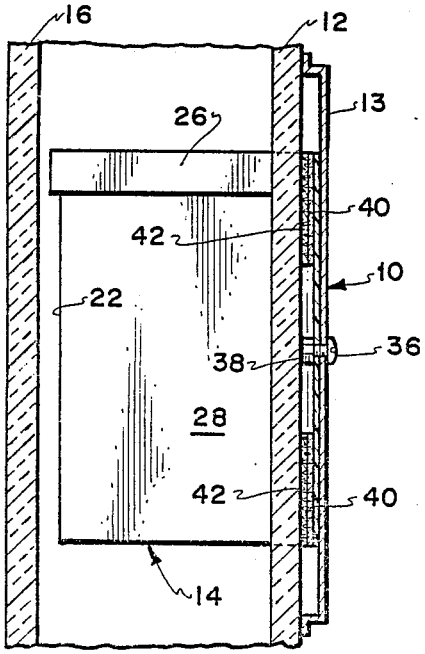
Fig. 3.
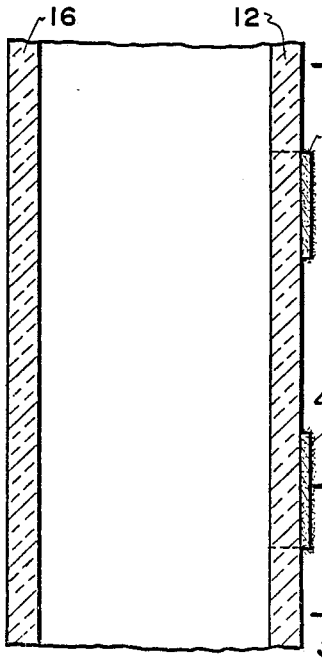
Fig. 4.
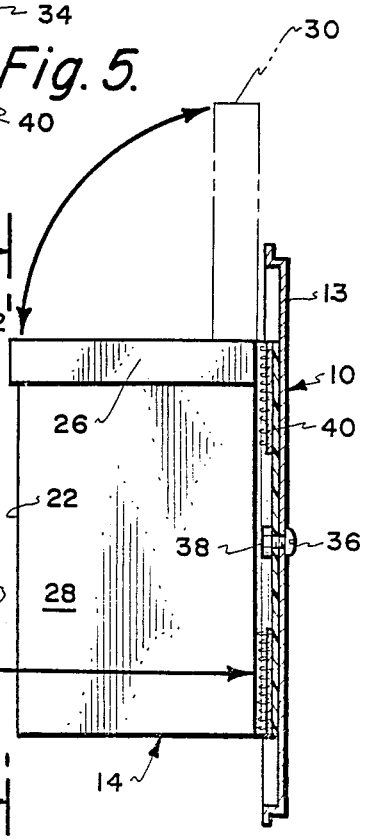

WALL SAFE SIMULATING AN AIR VENT

BACKGROUND OF THE INVENTION

1. Field of the Invention

This invention relates generally to wall safes for the storage of money, jewelry and other valuables and more particularly to a wall safe which simulates an air vent typically found in a building.

2. Description of the Prior Art

There are a number of devices described in the prior art which are referred to as wall safes and are used for storing valuables within the wall of a building. Examples include:

U.S. Pat. No. 4,370,935 issued to L. R. Link entitled, "Wall Safe and Door Hinging Means Therefor"

U.S. Pat. No. 4,176,533 issued to P. A. Nordendale entitled, "Wall Safe Lock"

U.S. Pat. No. 4,398,470 issued to A. R. Williams et al entitled, "Wall Safe".

Some prior art wall safes provide the user with a repository for valuables which assumes the appearance of an ordinary building instrumentality such as an electrical outlet or a piping system.

For example, U.S. Pat. No. 4,040,365 issued to R. F. Baxter entitled, "Utility System Wall Safe" discloses a wall safe that simulates the piping in a utility system. Baxter's disclosure utilizes a removable closure means which simulates the utility system extending from one face of the wall. The closure means includes a plug removably inserted in the vault pipe section, gasket means provided at the face of the wall for providing a seal, and an eccentrically tapered locking pin disposed in and passing through the vault pipe section. The plug compresses the gasket and maintains a seal at the face when the locking pin is in a locked position. The locking pin is removed and inserted from and into the plug at an opening in the wall remote from the vault pipe section. The locking pin includes a removable head pin for rotating the locking pin to release the gasket means out of sealing relationship with the wall.

The Baxter device requires a plurality of relatively expensive parts and is particularly adapted to be installed in a residence having a basement. In preferred embodiments although the pipe section is in a basement, the locking pin is in a remote location such as a doorway, window or the like. The valuables are therefore not very easily accessible.

U.S. Pat. No. 3,999,493 issued to J. Gulya entitled, "Vaults and Safes Employing Electrical Panel Assemblies" discloses a wall safe which assumes the appearance of an electrical outlet. The wall safe includes a sleeve which is rigidly positioned within a hole formed within the wall. A front panel with an electrical component having a simulated female power socket assembly is positioned for view. A repository section is firmly coupled to the front panel for retaining valuables. A latch is coupled to the electrical component and movable with respect to the front panel to coact with the sleeve when the safe is emplaced therein. The latch functions to retain the panel relatively flush with the wall in a first position and operate in a second position to permit the removal of the repository and panel from the hole. The latch is positioned to be operated by a key insertable into apertures in the socket assembly to operate the latch between the first and second positions.

As in the Baxter disclosure, the Gulya device requires a plurality of not easily fabricatable parts which makes the unit relatively expensive. Furthermore, there is a safety risk that small children witnessing its opening might attempt to imitate the user.

A wall safe that simulates an air vent for a building has been developed and marketed by Carol Products Company, Inc. of Irvington, N.J. That product (having the registered trademark "VENT A VAULT") includes a metal frame that is fitted within a hole formed in the wall and secured to the wall by screws. A front panel which simulates the air vent is coupled to a metal repository for containing valuables. The metal repository is secured to the metal frame by an interference fit. Valuables are secured within the repository by a heavy duty lock.

As in the Baxter and Gulya devices, the required plurality of parts makes the device relatively expensive. Furthermore, if the key is lost the device becomes inoperable.

OBJECTS AND SUMMARY OF THE INVENTION

A principal object of the invention, therefore, is to store and hide valuables within a building in a readily accessible and inexpensive manner.

Another object is to provide a wall safe which assumes the appearance of an air vent of the type normally used within residences and businesses.

Other objects, advantages and novel features of the present invention will become apparent from the following detailed description of the invention when considered in conjunction with the accompanying drawings.

The invention, in its broadest aspects, comprises a removable assembly and adhesive attachment means. The removable assembly includes a unitary receptacle for containing the valuables and a metal front panel. The unitary receptacle fits within a hole formed in the wall. The metal front panel is the type used for a conventional air vent and is securely attached to the unitary receptacle. The adhesive attachment means is adapted to attach the removable assembly to a section of the wall adjacent the assembly, thereby providing the appearance of a conventional air vent. The adhesive attachment means is further adapted to allow manual detachment of the removable assembly from the wall for the removal or addition of valuables.

In its narrower aspects the receptacle is a parallelepiped body with a pair of outwardly extending flanges. The parallelpiped body and flanges are unitarily formed of injection molded polypropylene. The flanges are screwed to the metal front panel. Adhesive strips are located on the back surfaces of the flanges and corresponding adhesive strips are located on the wall adjacent the periphery of the opening. Thus, the entire removable assembly may be detached from the wall by detaching the corresponding adhesive strips.

BRIEF DESCRIPTION OF THE DRAWINGS

FIG. 1 is a perspective view of the present invention shown in place within a wall.

FIG. 2 is a cross-sectional view of the wall safe taken along line 2—2 of FIG. 1.

FIG. 3 is a perspective side view of the wall safe, partially cut away, taken along 3—3 of FIG. 1.

FIG. 4 is a perspective side view of the wall safe, partially cut away. The wall safe is shown detached from the wall.

FIG. 5 is a back end view of the wall safe, taken along line 5—5 of FIG. 4.

The same elements or parts throughout the Figures of the drawings are designated by the same reference characters, while equivalent elements bear a prime designation.

DETAILED DESCRIPTION OF THE INVENTION

Figure 6:
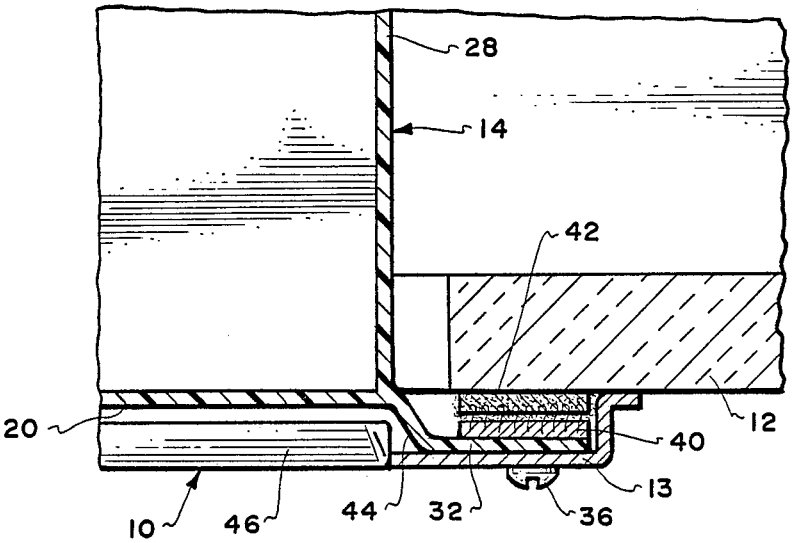
FIG. 6 is a cross-sectional view of a portion of the wall safe taken along lines 6—6 of FIG. 1.

Referring to the drawings and to the characters of reference marked thereon, FIG. 1 illustrates a front perspective view of the wall safe of the present invention, generally designated 10, shown mounted within an opening formed in the wall 12 of a building. When mounted, the wall safe 10 simulates a conventional air vent, only the conventional metal front panel 13 being visible.

As shown in FIG. 2, the apparatus 10 includes a receptacle, generally designated 14, which is dimensioned to fit within the recess 15 between two walls 12,16. The receptacle 14 serves as a repository for storing and hiding valuables. The receptacle preferably includes a body 18 which has a rectangular parallelepiped shape defined by a front wall 20, an opposing rear wall 22, a bottom wall 24, an opposing top wall or lid 26, and two opposing side walls 28 (one of which is shown in FIG. 3). The receptacle 14 is secured to the metal front panel 13 as a single removable assembly, as described in detail below.

As illustrated in FIG. 4, when valuables are added or removed from the receptacle 14, the apparatus 10 is detached from the wall 12 and the lid 26 may be opened as shown in phantom lines 30.

Referring now to FIG. 5, the receptacle 14 includes a pair of outwardly projecting flanges 32 which are substantially parallel with, and adjacent to, the front panel 13. Each flange 13 extends from a juncture 34 of the front wall 20 with a respective side wall 28. The entire receptacle 14 (including the flanges 32 and lid 26) may be unitarily formed, preferably by injection-molded polypropylene. The lid 26 is hingedly attached to the remainder of the receptacle 14 by means of a "living hinge" comprised of a decreased polypropylene wall thickness. The front panel 13 is rigidly secured to the flanges 32 by two screws 36 (see FIG. 1) and two bolts 38.

Each screw 36 projects through a hole centrally located on each end of the conventional front panel 13 and extends through a hole centrally located on each flange 32. Thus, the screws 36 simultaneously serve to simulate an actual air vent and to secure the front panel 13 to the receptacle 14. Four mating halves 40 of adhesive strips of synthetic material, of the type that adheres when pressed together with a corresponding mating strip (commonly sold under the trademark "VELCRO"), are permanently attached to the upper and lower ends of each flange 32. Four corresponding mating halves 42 of adhesive strips are permanently secured to the wall 12 adjacent the periphery of the opening formed in the wall 12. Thus, the apparatus 10 may be easily detached and re-attached to the wall for the removal or addition of valuables.

Figure 7:
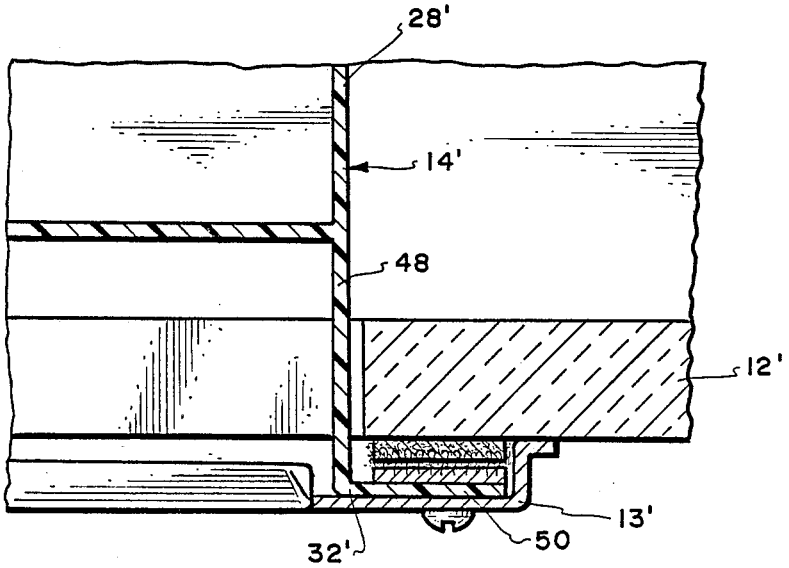
FIG. 7 is a cross-sectional view of a portion of a second embodiment of the present invention. The length of the flange is increased over the FIG. 6 embodiment to set the receptacle back away from the front panel.

As shown in FIG. 6, each flange 32 is substantially parallel to the surface of the wall 12 however, the flange 32 has a curved section 44 to provide ample space for the grill 46 on the front panel 13 and a proper flush engagement of the edge of the front panel 13 with the wall 12. FIG. 7 provides an alternate embodiment in which the receptacle 14′ is set back away from the front panel 13′. Each flange 32′ has a intermediate section 48 which extends from, and is parallel to, an adjacent side wall 28′. This makes it very difficult for the receptacle 14′ to be viewed when the apparatus 10 is emplaced within the wall 12′. Each flange 32′, as in the previous embodiment, has an end 50 which attaches to the front panel 13′.

The novel manner in which the present invention is fabricated (i.e. is formed of a unitary receptacle, two screws, a front panel, and adhesive strips) provides a hiding and storage product for many cost-conscious consumers who heretofore have been unable to afford relatively expensive prior art wall safes. Its approximate selling price to the ultimate consumer is approximately $12.00, compared to the hundreds of dollars that many prior art wall safes cost.

Obviously, many modifications and variations of the present invention are possible in light of the above teachings. It is therefore to be understood that, within the scope of the appended claims, the invention may be practiced otherwise than as specifically described.

For example, although the adhesive strips 40 have been shown to be secured to each flange 32, each flange might be shortened to the length of a short tab for engaging the screw 36 and bolt 38. Thus, the adhesive strip would be mounted directly onto the metal front panel 13.

What is claimed and desired to be secured by Letters Patent of the United States is:

1. An apparatus for storing and hiding valuables within the wall of a building, comprising:

a removable assembly, including a unitary receptacle for containing said valuables said receptacle having at least a major portion thereof being adapted to fit within an opening formed in said wall, said unitary receptacle including a substantially rectangular parallelepiped body defined by a front wall, two side walls, a rear wall and a bottom wall, a top wall for said parallelepiped body being at least partially removable from said parallelepiped body, and a metal front panel simulating a conventional air vent being securely attached to a front end of said unitary receptacle said panel being larger than said opening, said front panel being substantially parallel to said front wall; and adhesive attachment means being adapted to directly attach said removable assembly to a section of said wall adjacent the periphery of said opening when said major portion of said unitary receptacle is emplaced within said opening and thereby providing the appearance of a conventional air vent, said adhesive attachment means further being adapted to allow manual detachment of said removable assembly from said wall for the removal or addition of valuables.

2. The apparatus of claim 1 wherein said front wall is located adjacent an inner surface of said front panel.

3. The apparatus of claim 2, wherein said unitary receptacle further includes a pair of outwardly projecting flanges, each flange being substantially parallel with said front panel and having a front surface located adjacent said front panel, each flange extending from a juncture of said front wall with a respective side wall.

4. The apparatus of claim 3, further including two bolts and two screws, each screw projecting through a hole centrally located on each end of said metal front panel, as in a conventional air vent, and extending through a hole centrally located in each flange and terminating with a bolt, said bolts and screws for simulating a conventional air vent and for securely fastening said unitary receptacle to said metal front panel.

5. The apparatus of claim 4, wherein said adhesive attachment means includes at least one mating half of an adhesive strip of synthetic material of the type that adheres when pressed together with a corresponding mating strip, said mating half being permanently secured to a rear surface of each flange, the corresponding mating half being permanently secured to said section of said wall adjacent the periphery of said opening.

6. The apparatus of claim 5, wherein said adhesive attachment means includes two upper adhesive strips located near the top of each of said flanges and two lower strips located near the bottom of each flange.

7. The apparatus of claim 2, wherein said unitary receptacle is formed of injection molded polypropylene.

8. The apparatus of claim 7, wherein said top wall is hingedly attached to said parallelepiped body.

9. The apparatus of claim 8, wherein said top wall is hingedly attached by means of a "living hinge" comprised of a decreased polypropylene wall thickness at a juncture of the top wall and a top edge of said unitary receptacle.

10. The apparatus of claim 1, wherein said unitary receptacle includes:

a pair of flanges, each flange extending from a juncture of said front wall with a respective side wall, each flange having an end section being substantially parallel with said front panel with a front surface located adjacent said front panel, each said end section having a small hole centrally located therein, each flange further having an intermediate section substantially parallel to said side walls for setting the parallelepiped body back away from said front panel thereby preventing it from being viewed when said removable assembly is emplaced within the wall.

11. The apparatus of claim 10, further including two bolts and two screws, each screw projecting through a hole centrally located on each back end of said metal front panel, as in a conventional air vent, and extending through one of said small holes centrally located within each end portion, each screw terminating with a bolt for securely fastening said unitary receptacle to said metal front panel.

12. The apparatus of claim 11, wherein said adhesive attachment means includes at least one mating half of an adhesive strip of synthetic material of the type that adheres when pressed together with a corresponding mating strip, said mating half being permanently secured to a rear surface of each flange, the corresponding mating half being permanently secured to said section of said wall adjacent the periphery of said opening.

13. The apparatus of claim 12, wherein said adhesive attachment means includes two upper adhesive strips located near the top of each of said flanges and two lower adhesive strips located near the bottom of each flange.

14. The apparatus of claim 13, wherein said unitary receptacle is formed of injection molded polypropylene.

15. The apparatus of claim 14, wherein said unitary receptacle further includes a top wall hingedly attached to said parallelepiped body.

16. The apparatus of claim 15, wherein said top wall is hingedly attached by means of a "living hinge" comprised of a decreased polypropylene wall thickness at a juncture of the top wall and a top edge of said unitary receptacle.

17. A wall safe for storing and hiding valuables within the wall of a building, comprising:

a unitary receptacle for containing said valuables including a substantially rectangular parallelepiped body defined by a front wall, two side walls, a rear wall and a bottom wall, and a pair of outwardly projecting flanges, each flange extending from a juncture of said front wall with a respective side wall, each flange having an end section substantially parallel with said front wall;

a metal front panel simulating a conventional air vent fastened to each end section of each of said flanges, said metal front panel being fastened by a pair of screw fastening means; and, adhesive attachment means including a plurality of mating halves of adhesive strips of synthetic material of the type that adheres when pressed together with a corresponding mating strip, said mating halves of adhesive strips being permanently affixed to said end sections of said flanges and corresponding mating strips permanently affixed to said wall adjacent the periphery of said opening, wherein when said unitary receptacle is emplaced within said opening the mating halves of adhesive strips on said unitary receptacle engage the corresponding adhesive strips on the wall and provide the appearance of a conventional air vent, said unitary receptacle and metal front panel being removable from said wall by detaching said adhesive strips and thereby allowing the removal or addition of valuables.

18. An apparatus for storing and hiding valuables within the wall of a building, comprising:

a removable assembly, including a unitary receptacle for containing said valuables, said receptacle having at least a major portion thereof being adapted to fit within an opening formed in said wall, said unitary receptacle including a substantially rectangular parallelepiped body defined by a front wall, two side walls, a rear wall, a bottom wall, and a top wall, said top wall being hingedly attached to said parallelepiped body, said parallelepiped body being formed of injection molded polypropylene, and a metal front panel simulating a conventional air vent being securely attached to a front end of said unitary receptacle said panel being larger than said opening, said front wall being substantially parallel to and located adjacent an inner surface of said front panel; and adhesive attachment means being adapted to directly attach said removable assembly to a section of said wall adjacent the periphery of said opening when said major portion of said unitary receptacle is emplaced within said opening and thereby providing the appearance of a conventional air vent, said adhesive attachment means further being adapted to allow manual detachment of said removable assembly from said wall for the removal or addition of valuables.

19. An apparatus for storing and hiding valuables within the wall of a building, comprising:

a removable assembly including a unitary receptacle for containing said valuables, said receptacle including a substantially rectangular parallelepiped body defined by a front wall, two side walls, a rear wall and a bottom wall, and a metal front panel simulating a conventional air vent being securely attached to front end of said unitary receptacle, said panel being larger than said opening, said front wall being substantially parallel to said front panel; and adhesive attachment means including at least one pair of mating halves of adhesive strips of synthetic material of the type that adheres when pressed together with a corresponding mating strip, said mating half of adhesive strip being permanently affixed to said unitary receptacle and a corresponding mating strip permanently affixed to said wall adjacent the periphery of said opening, wherein when said unitary receptacle is emplaced within said opening, the mating half of adhesive strip on the unitary receptacle engages the corresponding adhesive strip on the wall, thereby providing the appearance of a conventional air vent, said unitary receptacle and metal front panel being removable from said wall by detaching said adhesive strip and thereby allowing the removal or addition of valuables.

* * * * *